United States Patent [19]

Hile

[11] Patent Number: 4,468,990

[45] Date of Patent: Sep. 4, 1984

[54] SOCKET WRENCH ASSEMBLY

[76] Inventor: Jeffrey B. Hile, R.D. #1, Box 122, Imperial, Pa. 15126

[21] Appl. No.: 477,928

[22] Filed: Mar. 23, 1983

[51] Int. Cl.[3] ..... B25B 13/46

[52] U.S. Cl. ..... 81/60; 81/177 N; 81/439; 16/110.5; 145/62

[58] Field of Search ..... 81/60, 62, 177 R, 177 M, 81/177 N, 439; 145/61 R, 61 J, 61 L, 62, 63, 75; 16/110.5; 206/375, 378

[56] References Cited

U.S. PATENT DOCUMENTS

| | | | |
|---|---|---|---|
| 1,937,645 | 12/1933 | Fegley et al. | 145/62 |
| 3,006,395 | 10/1961 | Dye | 81/177 N X |
| 3,426,813 | 2/1969 | Robertson | 145/62 |
| 4,227,430 | 10/1980 | Jansson et al. | 81/177 M |

FOREIGN PATENT DOCUMENTS

| | | | |
|---|---|---|---|
| 951860 | 11/1956 | Fed. Rep. of Germany | 145/62 |
| 3004958 | 8/1981 | Fed. Rep. of Germany | 145/62 |

*Primary Examiner*—James G. Smith

*Attorney, Agent, or Firm*—Webb, Burden, Robinson & Webb

[57] ABSTRACT

A reversible ratchet socket wrench assembly having a handle portion with a base containing the gear mechanism and a cylindrical sidewall at the upper edge of the base. The cylindrical sidewall and the base define a recess for storing sockets and a cover on the upper edge of the cylindrical sidewall closes the recess. A stub extends downwardly from the gear mechanism and an elongated drive shaft for a socket is attached to the stub. A bore extends from the bottom of the recess through the gear mechanism and the stub to connect with a bore formed in the upper end of the drive shaft which forms an elongated storage bore in the wrench assembly for storing a power bar.

7 Claims, 3 Drawing Figures

SOCKET WRENCH ASSEMBLY

BACKGROUND OF THE INVENTION

1. Field of the Invention

The invention relates generally to a reversible ratchet drive socket wrench assembly and more particularly to a reversible ratchet drive socket wrench assembly having a continuous elongated axial bore in the handle portion and the drive shaft for storing a power bar and a closed compartment in the handle portion for storing a plurality of individual sockets of different sizes. The elongated bore and the closed compartment are integral parts of the socket wrench assembly so that the power bar and different size sockets are always available at the work site where a mechanic will use the wrench.

2. Description of the Prior Art

Socket wrenches and screwdrivers are available in the prior art which include a storage section in the handle to store spare sockets or screwdriver bits. A socket wrench having a handle adapted to store various size sockets is disclosed in U.S. Pat. Nos. 4,253,356 and 4,302,990. However, in these socket wrenches, the axis of the wrench handle wherein the spare sockets are stored is perpendicular to the axis of the socket receiving stub, and the wrench assembly is unwieldy and cannot be used in confined locations. Additionally, in the socket wrenches disclosed in the two aforementioned patents, the spare sockets are exposed while they are in the storage section of the handle and can easily slip or be knocked out of the handle causing them to become misplaced.

A tool with storage compartment having an axis which is coaxial with the axis of the drive shaft of the tool is disclosed in U.S. Pat. No. 4,086,831. In that patent the hollow handle has a plurality of individual chambers to hold extra screwdriver bits.

SUMMARY OF THE INVENTION

The invention is a reversible ratchet socket wrench assembly having a handle portion with a stub and a drive shaft permanently attached thereto. The handle portion is formed with an elongated axial bore which communicates with an elongated axial bore in the drive shaft. The two bores receive a removable power bar which may be inserted through an opening in the upper end of the drive shaft to increase the torque on the socket at the lower end of the drive shaft. The handle portion is also formed with a recess which communicates with the upper end of the bore and which forms a storage compartment for a plurality of sockets of different sizes. Access to the storage compartment is provided by a removable cover on the upper end of the handle portion.

DESCRIPTION OF THE PREFERRED EMBODIMENT

Figure 1:
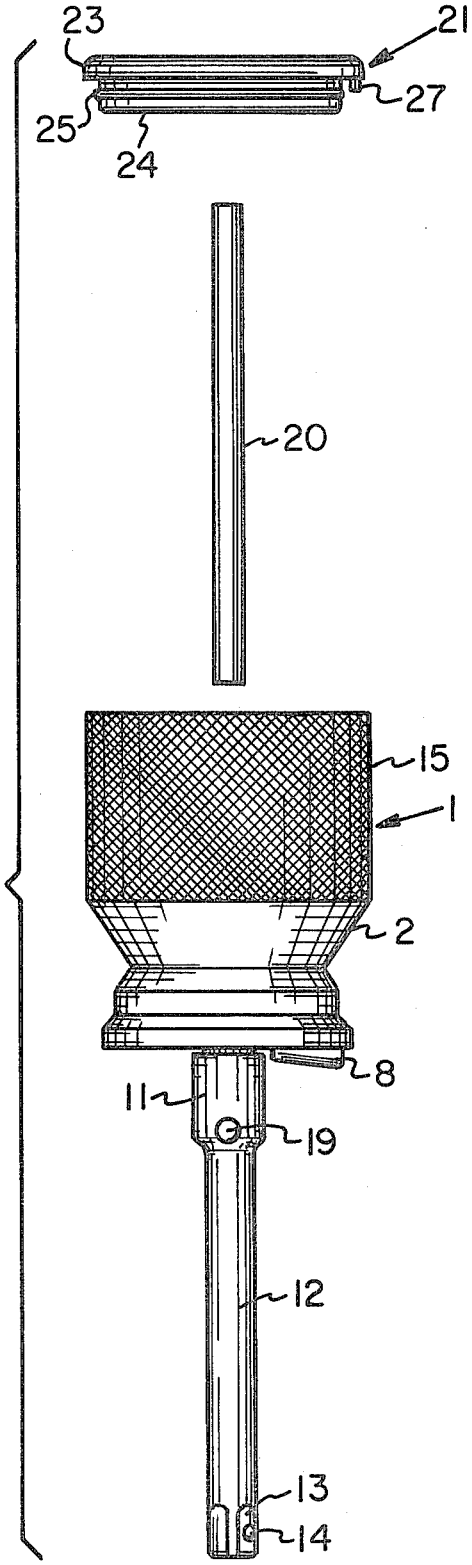
FIG. 1 is an exploded view of the socket wrench assembly of the invention.
Figure 2:
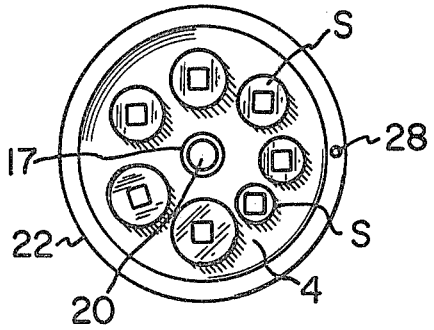
FIG. 2 is a plan view of the socket storage compartment with the cover removed and the power bar and a number of sockets stored therein.

The socket wrench assembly of the invention has a plurality of interchangeable sockets S with different size openings to embrace different size nuts and bolts. The wrench assembly consists of a handle portion 1 having a base 2 and a stub 3 extending downwardly at the lower end of the base. The handle portion 1 includes a cylindrical sidewall 5 which is integral with base 2 and extends upwardly therefrom to define a cylindrical recess 4 located above base 2 and having an open upper end. The cylindrical recess will receive a plurality of sockets S for storage.

Figure 3:
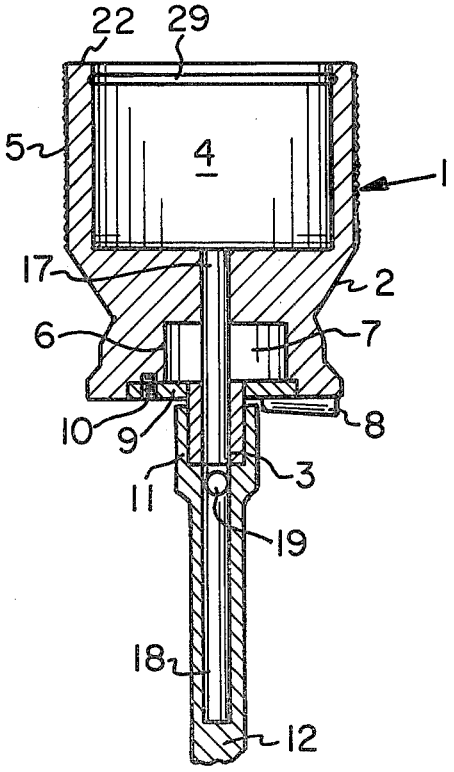
FIG. 3 is a vertical section through the wrench with the cover removed and the drive shaft broken off.

The base is formed with a downwardly opening cavity 6 which holds a standard reversible gear mechanism 7 which may be reversed by a finger lever 8 and which has stub 3 attached to its lower end. The reversible gear mechanism is shown schematically in FIG. 3 of the drawings. One such mechanism is manufactured by Craftsman Corporation, and the details thereof form no part of the present invention. The cavity 6 which contains ratchet mechanism 7 is closed by a cover plate 9 which is held in place on base 2 by a plurality of machine screws 10. Stub 3 extends downwardly from gear mechanism 7 through a hole in cover plate 9 and is formed in transverse cross section with a square exterior configuration which fits within a hollow square cup 11 integrally formed at the upper end of elongated drive shaft 12. The drive shaft is held in place on stub 3 by a Allen screw (not shown) extending through the wall of cup 11 into an hole in stub 3. The lower end of drive shaft 12 is a standard socket drive end 13 having a transverse cross section with a square exterior configuration to fit within the square opening in a standard socket S. Drive end 13 has a spring loaded ball 14 to hold a socket S on the end of drive shaft 12. The exterior surface of cylindrical sidewall 5 of handle portion 1 is knurled as shown at 15 to provide a firm gripping surface for a mechanic operating the wrench.

An axial bore 17 is drilled downwardly at the center line of base 2 and extends from the bottom of recess 4, through gear mechanism 7 and stub 3. This elongated bore communicates with and is coaxial with an elongated axial bore 18 which is drilled through a portion of the length of elongated drive shaft 12. A diametric hole 19 is drilled completely through the base of cup 11 at the upper end of the drive shaft. The axis of hole 19 is perpendicular to the axis of drive shaft 12 and bore 18.

A cylindrical power bar 20 is stored within the connected bores 17 and 18 when it is not in use. The upper end of the power bar extends a slight distance into recess 4 of handle portion 1 so that it may be easily grasped for removal from bores 17 and 18. When it is necessary to use power bar 20, it is removed from connected bores 17 and 18 and inserted through hole 19 so that it is at right angles to the axis of drive shaft 12. Additional torque may now be provided to the drive shaft to loosen or tighten a nut or bolt with which the socket attached to end 13 of drive shaft 12 is engaged.

A circular cover 21 fits on the upper end 22 of cylindrical sidewall 5 in handle portion 1 to close recess 4 to form a closed compartment for storing the sockets S and the upper end of power bar 20. Cover 21 has an outwardly extending annular lip 23 which will overlie the upper edge 22 of cylindrical sidewall 5 when the cover is in place. A downwardly extending cylindrical portion 24 is integral with lip 23 and fits within recess 4. A rubber O-ring 25 is held within an annular groove formed on the edge of cylindrical portion 24. This O-ring fits within an annular groove 29 formed on the inner surface of cylindrical sidewall 5 when cover 21 is in place to close recess 4 and holds cover 21 in place. The cover has a downwardly depending pin 27 which fits within a hole 28 in the upper edge 22 of cylindrical sidewall 5 of the handle portion. The insertion of the pin 27 within hole 28 ensures that cover 21 will not rotate when handle portion 1 is rotated to tighten or loosen a nut or a bolt.

When utilizing the socket wrench of the invention, it is necessary to first remove cover 21 and remove a socket S from recess 4 and place it on the lower end 13 of drive shaft 12. The cover is then replaced and the socket S is placed over a nut or a bolt which is to be tightened or loosened. If the nut or bolt is to be loosened and it cannot be freed, the mechanic will remove cover 21 and place power bar 20 through hole 19 to obtain additional torque on the nut or the bolt. After the nut or the bolt has been freed, the power bar is removed from hole 19 and reinserted into the elongated storage bores 17 and 18.

It will be seen that the invention provides an integral reversible ratchet socket wrench assembly having a storage compartment for sockets and a storage bore for an elongated power bar which prevents the sockets and the power bar from being misplaced. The invention eliminates the necessity of carrying both the ratchet wrench and a tray containing the sockets and the power bar which is the normal practice when utilizing a standard commercial socket wrench.

While a preferred embodiment of the invention has been shown and described, it is to be understood that the invention may be embodied within the scope of the appended claims.

I claim:

1. A reversible ratchet socket wrench assembly including a cylindrical handle portion having a base, a cavity located within the lower portion of said base and a gear mechanism located within said cavity, a downwardly depending stub extending from said gear mechanism with its lower end located below the bottom of said base, an elongated downwardly extending drive shaft attached to and coaxial with the lower end of said stub, a cylindrical sidewall extending upwardly from the perimeter of said base to define an open top recess above the upper surface of said base adapted to receive a plurality of sockets, the lower end of said drive shaft having means to attach said drive shaft to a socket, an elongated upper bore coaxial with said base and said stub and extending from the upper surface of said base through said ratchet mechanism and said stub to the lower end of said stub, an elongated lower bore coaxial with said drive shaft extending from the upper end of said drive shaft toward the lower end of said drive shaft and terminating within said drive shaft, said lower bore connecting with said upper bore to form an elongated storage bore adapted to receive a power bar.

2. A socket wrench assembly as set forth in claim 1 including a diametric hole extending through the upper end of said drive shaft to receive said power bar, whereby additional torque may be applied to said drive shaft.

3. A socket wrench assembly as set forth in claim 1 wherein the outer surface of said cylindrical sidewall of said handle portion is knurled to provide additional gripping surface on said socket wrench assembly.

4. A socket wrench assembly as set forth in claim 1 including a cylindrical cover for said recess, said cover comprising an annular lip having an outer diameter substantially the same as the outer diameter of said cylindrical sidewall and a cylindrical portion depending from said lip having a diameter slightly less than the interior diameter of said cylindrical sidewall and means to attach said cover to the upper open end of said cylindrical sidewall, whereby said cover and said recess provide a closed compartment for storing a plurality of sockets and the upper end of a power bar.

5. A socket wrench assembly as set forth in claim 4 wherein said means to attach said cover on the upper open end of said cylindrical sidewall is a resilient O-ring located in an annular groove in the periphery of said cylindrical portion, whereby said resilient O-ring is compressed when said cover is placed on said cylindrical sidewall and contacts the inner surface of said cylindrical sidewall.

6. A socket wrench assembly as set forth in claim 5 wherein the inner surface of said cylindrical sidewall is formed with an annular groove adjacent the upper end of said sidewall and said O-ring fits within said annular groove when said cover is on the upper open end of said sidewall to close said recess.

7. A socket wrench assembly as set forth in claim 4 including a pin extending downwardly from said lip and a hole in the upper open end of said cylindrical sidewall adapted to receive said pin when said cover is in place on the upper end of said cylindrical sidewall.

* * * * *